US006819207B2

(12) United States Patent
Hertzog et al.

(10) Patent No.: US 6,819,207 B2
(45) Date of Patent: Nov. 16, 2004

(54) ROTARY ELECTROMAGNET

(75) Inventors: Nicolas Hertzog, Rueil-Malmaison (FR); Pascal Machon, Colombes (FR); Franck Declomesnil, Paris (FR)

(73) Assignee: Schneider Electric Industries SAS (FR)

( * ) Notice: Subject to any disclaimer, the term of this patent is extended or adjusted under 35 U.S.C. 154(b) by 10 days.

(21) Appl. No.: 10/258,346

(22) PCT Filed: Apr. 26, 2001

(86) PCT No.: PCT/FR01/01300

§ 371 (c)(1),
(2), (4) Date: Jan. 16, 2003

(87) PCT Pub. No.: WO01/84578

PCT Pub. Date: Nov. 8, 2001

(65) Prior Publication Data

US 2004/0017274 A1 Jan. 29, 2004

(30) Foreign Application Priority Data

May 2, 2000 (FR) ..... 00 05739

(51) Int. Cl.[7] ..... H01H 67/02
(52) U.S. Cl. ..... 335/132; 335/78; 335/229
(58) Field of Search ..... 335/78–86, 132, 335/202, 220–229, 124, 128

(56) References Cited

U.S. PATENT DOCUMENTS 4,135,119 A * 1/1979 Brosens ..... 318/128
5,029,618 A 7/1991 Kleiner
5,994,987 A * 11/1999 Passow ..... 335/78
6,674,349 B1 * 1/2004 Bolongeat et al. ..... 335/229

FOREIGN PATENT DOCUMENTS

DE 30 05 921 A1 9/1981
JP 57-010910 1/1982

* cited by examiner

*Primary Examiner*—Lincoln Donovan
(74) *Attorney, Agent, or Firm*—Parkhurst & Wendel, L.L.P.

(57) ABSTRACT

An electromagnetic device of a switching apparatus including a mobile armature for rotating in a fixed frame between two inactive and active positions, at least one permanent magnet mounted in the fixed frame, and at least one coil mounted in the mobile armature and control means for delivering a control current into the coil. The mobile armature is monostable; in an inactive position, a lever actuated by the mobile armature separates the fixed contacts from the mobile contacts of the apparatus. In an active position, the lever is released from the mobile armature and a spring presses the mobile contact against the fixed contacts.

13 Claims, 2 Drawing Sheets position R position T

ROTARY ELECTROMAGNET

This invention relates to an electromagnetic control device for opening and closing contacts, comprised of a movable armature rotating between two stops. Said device is particularly suited for use in a low voltage power switch such as a contactor or contactor/breaker.

An electromagnetic control device comprising a mobile armature rotating between two positions formed by two stops arranged in a fixed frame and comprising at least one permanent magnet and at least one coil on a fixed frame (see patent application N° FR9906592). The permanent magnet serves to maintain the mobile armature in a given position when the coil is not creating a magnetic field. Said device is bistable and, in order to switch the mobile armature from one position to another, it is necessary to circulate a current in the coil either in one direction or in the other or, if using two opposed coils, in such a fashion as to create a magnetic field, in one direction or in another, greater than that generated by the permanent magnet. Consumption by such a device is thus significant. In other respects, DE3005921 discloses a monostable electromagnetic control device, in which at least one magnet is counted on a mobile armature and a coil is mounted on the fixed frame. But the fact of mounting the coil or coils in the fixed frame involves an undesirable increase of the size of the entire device.

On the other hand, U.S. Pat. No. 5,029,618, discloses an electromagnetic control applied to a mechanism for textile machinery. Said device is either rotary and bistable or linear and monostable in virtue of an asymmetry of the air gap of the two magnets comprising it. Therefore, the power of the one device is not adapted for efficiently opening and closing the power contacts of a switching apparatus such as is desired in the invention.

The object of the present invention is to provide the simplest possible electromagnetic control device for a switching apparatus capable of responding to extreme constraints of space requirements and consumption.

In order to achieve this, the invention describes an electromagnetic control device for opening and closing contacts of a switching apparatus comprising:

- a monostable mobile armature that is mobile in rotating about an axis of rotation within a fixed frame between two stops delimiting a inactive position and an active position, respectively, and which mechanically cooperates with an actuation lever for the contacts, the mobile armature comprising an elongated core along a longitudinal axis running perpendicular to the axis of rotation and having two convex opposing ends.
- at least one permanent magnet mounted in the fixed frame along an axis of magnetization passing through the axis of rotation and having a polar surface that is substantially concave in shape with respect to at least one end of the mobile armature;
- at least one coil mounted on the mobile armature;
- control means capable of delivering a control current into said coil(s).

In the presence of a control current in the coil of a value of zero or less than the threshold of activation, the mobile armature switches to a first of the aforesaid two positions (inactive and active, respectively) by virtue of the force of attraction of the permanent magnet (s). In the presence of a command current of a value greater than the threshold of activation greater than or equal to the threshold of activation, the mobile armature switches to the second of the aforesaid two positions (inactive and active, respectively) by virtue of the force of repulsion of the permanent magnet(s).

According to one characteristic, the fixed frame comprises two permanent magnets that are positioned symmetrically relative to the axis of rotation of the mobile armature and which each have a polar surface that is substantially concave cooperating with one opposed convex end of the mobile armature in such a fashion as to minimize the forces necessary to the switching movements of the mobile armature. The longitudinal axis of the core of the mobile armature is always displaced on the same side relative to the axis of magnetization of the two permanent magnets.

The coil(s) is (are) mounted on the mobile armature by means of a cage or housing that encloses the core and which exhibits transverse clamps or rings at least one of which cooperating with an interior surface of the fixed frame.

According to another characteristic, the control means comprises an electronic circuit capable of receiving an input of an opening instruction and a closing instruction and delivering to the output a control current into the coil(s) (24, 25).

A further object of the invention is a switching apparatus equipped with one such electromagnetic control device.

Other advantages and characteristics of the invention issue from the following detailed description read together with the annexed drawings, in which.

Figure 4:
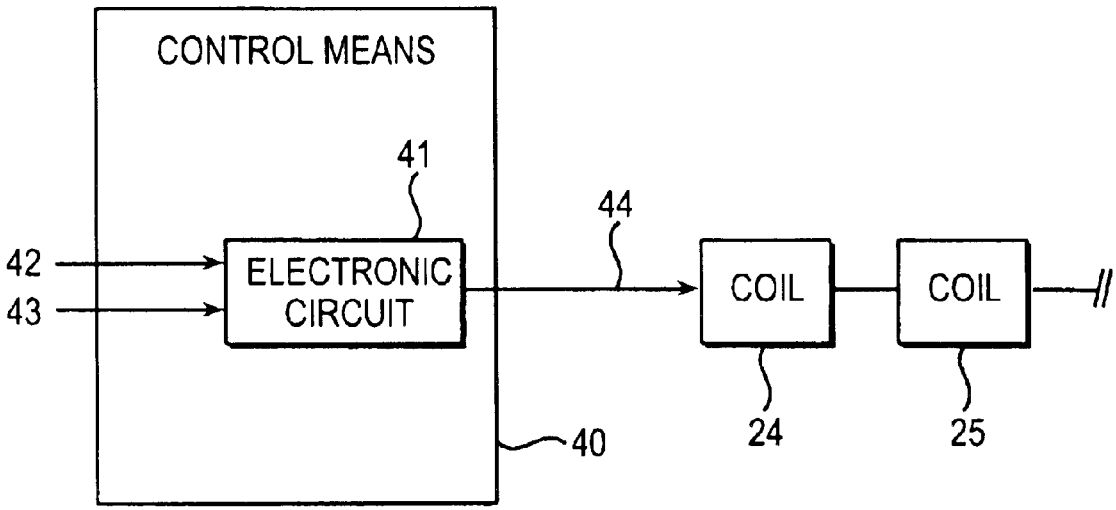

FIG. 4 details the control means of the device.

The electromagnetic control device is intended for opening and closing of the contacts of a switching apparatus. According to the embodiment represented in FIG. 1 it comprises a metal fixed frame 10, indentations on the inside of which a mobile armature 20 is situated between two stops arranged on the fixed frame 10 delimiting an inactive R position and an active T position, about an axis of rotation 21 perpendicular to a longitudinal axis 22 of the mobile armature 20. A first stop, delimiting the inactive R position, is made up of two initial inside surfaces 12, 12' of the fixed frame 10, symmetrical relative to the axis of rotation 21. A second stop, delimiting the active T position, is made up of two second inside surfaces 13, 13' of the fixed frame, symmetrical relative to the axis of rotation 21. The mobile armature 20 is comprised of an elongated metal core 29 along the longitudinal axis 22 exhibiting two opposed convex ends 23, 23' mounted symmetrically about its axis of rotation 21.

The mobile armature 20 cooperates mechanically with a actuation lever 30 for the contacts of the switching apparatus by means of a pin 19 mounted on the mobile armature 20 in such a fashion that in the inactive position R the mobile armature 20 controls the separation between the mobile contacts 32 and the fixed contacts 31 of the switching apparatus. In the inactive R position, this control is transmitted by the pin 19 which operates the lever 30, itself entraining by pivoting an attached pusher 33 of a contact holder 34 supporting the mobile contacts 32 (see FIG. 1). When the mobile armature 20 is in the active T position, the pin 19 is separated from the lever 20 (see FIG. 2). The application of the mobile contacts 32 on the fixed contacts 31 of the switching apparatus is thus assured by a contact compression spring 35 that bears upon the contact holder 34 and upon a fixed support 36 of the switching apparatus.

Figure 1:
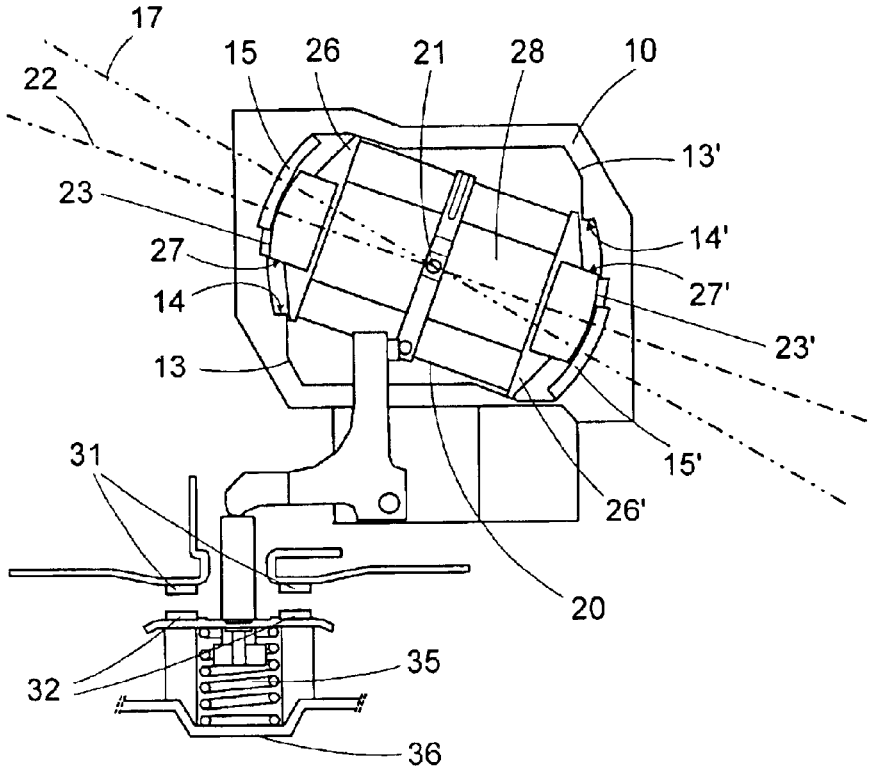
FIG. 1 represents an embodiment of an electromagnetic control device for opening and closing contacts in its inactive position.

With reference to FIG. 1, the mobile armature 20 has a cage or housing 28 surrounding the metal core 29 and on which at least one coil is arranged. In a preferred fashion, two coils 24, 25 mounted electrically in series are arranged on either end of the axis of rotation 21 along the longitudinal axis 22 of the mobile armature 20. The cage 28 of the coils additionally has at its ends several transverse rings 26, 26'. The limitation of the movements of the mobile armature 20 is obtained:

- by means of one of the rings 26, 26' which cooperates with a stop formed by at least one of the two first inside surfaces 12, 12' of the fixed frame 10, thus delimiting the inactive R position;
- by the core 29 one of whose lateral surfaces 27, 27' cooperates with a stop formed by at least one of the two flanges 14, 14' of the fixed frame 10, thus delimiting the active T position.

This type of assembly allows significant reduction of the total space requirement of the device by not necessitating placement for the coils 24, 25 on the fixed frame 10.

At least one permanent magnet 15, 15' is fixed inside the fixed frame 10. Advantageously, the fixed frame 10 comprises on its inside part two permanent magnets 15 (15', respectively) positioned symmetrically relative to the axis of rotation 21 of the mobile armature 20 and each having one polar surface 16 (16', respectively) that is substantially concave and positioned with respect to a same convex extremity 23 (23', respectively) of the mobile armature 20. The substantially concave form of the polar surfaces 16, 16' and the convex shape of the ends 23, 23' are particularly adapted so that these polar surfaces 16, 16' cooperate with these ends 23, 23' in such fashion as to minimize the dimension of the air gap created between the magnets 15, 15' and the core 29 in such fashion as to minimize the variations of said air gab during the movements of the mobile armature 20. This thus allows reduction of the forces necessary to the switching movements of the mobile armature 20.

Figure 2:
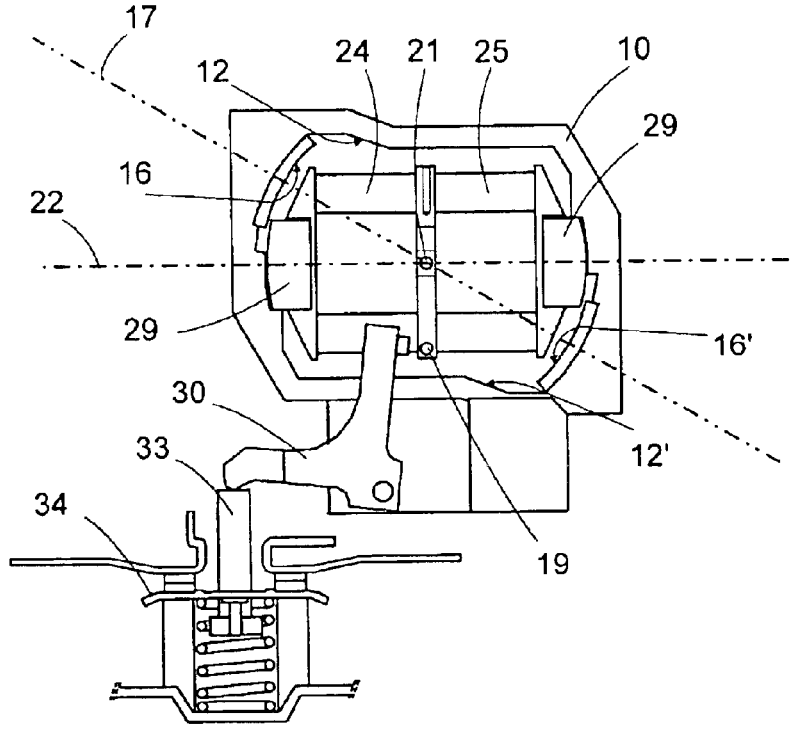
FIG. 2 represents the same electromagnetic control device in its active position.

As shown in FIGS. 1 and 2, the two magnets 15, 15' are magnetized along substantially the same axis of magnetization 17. The direction of magnetization of the two magnets 15, 15' is opposed by one relative to the other; that is, the pole of the polar surface 16 is the reverse of the pole of the polar surface 16'. The axis of magnetization 17 passes through the axis of rotation 21 of the mobile armature 20 and is perpendicular to the axis of rotation 21. The advantage of having the polar surfaces of the magnets that cooperate with the ends of the mobile armature allows giving the maximum amplitude to the attraction/repulsion forces of the magnets of the mobile armature.

The device according to the invention is constructed in such a fashion that the longitudinal axis 22 of the core 29 of the mobile armature 20 crosses the axis of magnetization 17 of the permanent magnets substantially at the level of the axis of rotation 21. Moreover, the longitudinal axis 22 is displaced from the same side relative to the axis of magnetization 17, regardless of the position of the mobile armature 20, whether in the inactive R position or the active T position, with an angle greater than 0° and less than 60°.

With reference to FIG. 4, the electromagnetic control device comprises also control means 40 capable of delivering a control current 44 to the coils 24, 25. The control means 40 comprise an electronics circuit 41 that can receive at entry a closing instruction 42 and an opening instruction 43 and which, as a function of these inputs, delivers at the output the control current 44 into the coils 24, 25 of the mobile armature 20.

The operation of the present electromagnetic control device will now be described.

When an opening instruction 43 is received by the electronics circuit 41, the latter delivers into the coils 24, 25 a control current 44 of a zero value or less than an opening threshold D memorized in the electronics circuit 41. This opening threshold D is calculated such that the induced magnetic field B that results in the coils 24, 25 is sufficiently lower than the magnetic field M of the permanent magnets so that the metal core 29 of the mobile armature 20 is attracted by the permanent magnets 15, 15' and switches towards a first of two positions, to the inactive R position, for example. As the longitudinal axis 22 of the core 29 is always displaced from the same side relative to the axis of magnetization 17 of the permanent magnets, this means that, even when the mobile armature has reached the R position, the permanent magnets 15, 15' continue to exercise in the same direction an attraction force 61 on the mobile armature 20, thus allowing it to be firmly held in the inactive position R.

When a closing instruction 42 is received by the electronics circuit 41, it delivers to the coils 24, 25 a control current 44 of a value greater than a closing threshold E memorized in the electronics circuit 41. This closing threshold E is greater than the opening threshold D and is calculated such that the induced magnetic field B that results in the coils is sufficiently greater than the magnetic field M of the permanent magnets 15, 15' that the mobile armature 20 is repelled by the magnets 15, 15' and switched towards the second of the two positions, the active position T, for example. When the mobile armature 20 is in the T position, the two lateral faces 27, 27' of the core 29 of the mobile armature are in contact with the flanges 14, 14' of the fixed metal frame 10, which limits the movement and also permits the electromagnetic flux generated by the coils to loop back between the metal core 29 and the fixed frame 10 in such a fashion as to assure effective holding in the T position.

Switching over from the active T position to the inactive R position does not consume current, since it is due only to the force of attraction of the permanent magnets 15, 15' on the mobile armature 20. Reciprocally, as there is no return spring to maintain the mobile armature 20 in this R position; thus, a low control current level 44 in the coils 24, 25 is sufficient to switch from the R position to the T position, thus entailing globally a very low consumption for the entire device. Likewise, the force necessary to bring the mobile contacts 32 up against the fixed contacts 31 does not consume any more current because it is assured by the spring 35.

Thus, given that the electromagnetic control device according to the invention never passes through an equilibrium position, since the longitudinal axis 22 of the core 29 is always offset from the same side relative to the axis of magnetism 17 of the permanent magnets and given that the low values of air gap and variations of air gap during the movements of the mobile armature 20, the result of which is that the attraction/repulsion forces associated with the permanent magnets are almost linear over the entire course of the mobile armature 20 and thus the R and T positions are very stable positions. In this fashion, high efficacy is achieved permitting the device to rapidly bring up and separate the mobile contacts 32 and the fixed contacts 31 of a power switching apparatus, even for higher electrical intensities.

Figure 3:
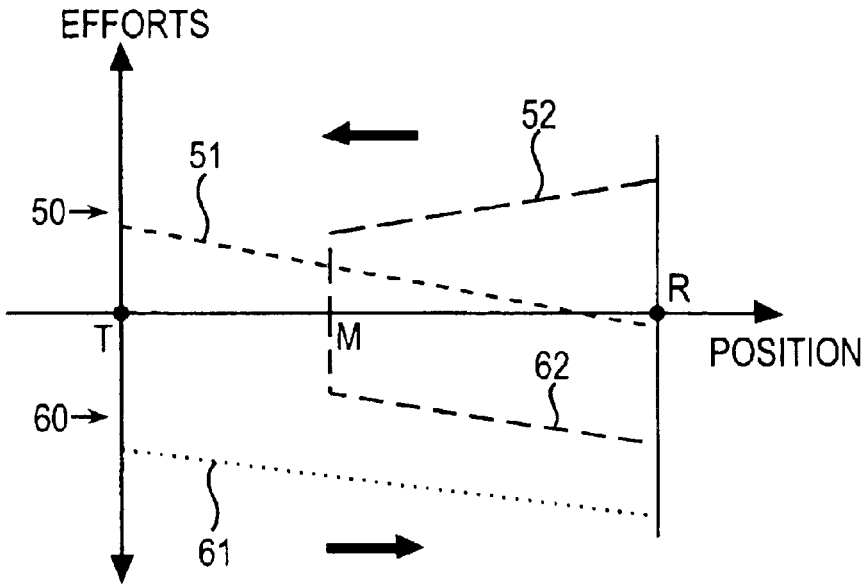
FIG. 3 illustrates the course of the different force curves acting upon the mobile armature of the device.

FIG. 3 illustrates what would be the course of the different force curves acting upon the mobile armature 20 of the device according to the invention. In this illustration, the axis of the abscissas represents the course of the mobile armature between the active T position and the inactive R position. The portion above 50 of the graphic represents the forces at the time of movement of the mobile armature 20 from the R position towards the T position. The portion below 60 of the graphic represents the forces at the time of movement of the mobile armature 20 from the T position towards the R position.

Between the T position and a medial M position situated between T and R, the actuation lever 30 is dissociated from the mobile armature 20. Between the M position and the R position, the lever 30 is mechanically entrained by the pin 19 of the mobile armature 20 in order to separate the mobile contacts 32 form the fixed contacts 31 of the switching apparatus. The forces associated with the permanent magnets 15, 15' are represented by the curves 51 and 61. The forces associated with the contact compression spring 35 are represented by the curves 52 and 62, these forces being present only between the M position and the R position of the mobile armature.

In the part below 60, the coils 24, 25 are traversed by a current 44 of zero value or less than the opening threshold D. Thus the force of attraction of the permanent magnets 15, 15' generates a motive force on the mobile armature, represented by the curve 61; this force causing the mobile armature to pass from the T position in the direction of the R position. The force 61 must be greater than the repelling force represented on the curve 62. This repelling force 62 corresponds to the compression of the contact pressure spring 35 opposing the force of attraction of the permanent magnets between the M position and the R position; that is, when the actuation lever 30 engages the mobile contacts 32 of the switching apparatus.

In the part over 50, the coils 24, 25 are traversed by a current 44 with a value greater than the closing threshold E. The motive force associated with the permanent magnets 15, 15' is thus reversed and from this point on entrains the mobile armature 20 from the R position towards the T position, as indicated in the curve 51. The force represented by the curve 52 that is generated by the contact compression spring 35 between the R position and the M position becomes from this point on a motive force that is additive to the motive force 51 facilitating the passage from the R position to the T position. It is noted that this motive force 51 on the mobile armature has no need to be significant because between the R position and the M position it is assisted by the force 52 from the contact compression spring 35 and, after the M position, as the actuation lever 30 no longer mechanically engages the mobile contacts of the switching apparatus, the motive force 51 must only just engage and then maintain the mobile armature weakly in the T position without encountering a repelling force. This has as its effect the low consumption by the electromagnetic control device, while lowering the closing threshold E of the current 44 into the coils 25, 25.

It is obvious that variations and enhancements of the detail and even envisaging of the use of equivalent means can be inspired without departing from the context of the invention.

What is claimed is:

1. An electromagnetic control device for opening and closing of contacts of a switching apparatus, comprising:

a fixed frame;

a contacts actuation lever;

a monostable mobile armature for rotation about an axis of rotation in the fixed frame between two stops delimiting, respectively, an inactive (R) position and an active (T) position, and which cooperates mechanically with the contacts actuation lever, the mobile armature comprising a core that is elongated along a longitudinal axis of the core and is perpendicular to the axis of rotation and has two opposing concave ends;

at least one permanent magnet mounted inside the fixed frame along an axis of magnetization intersect the axis of rotation of the mobile armature and having a polar surface that is substantially concave relative to one end of the mobile armature;

at least one coil located on the mobile armature; and control means for delivering a control current to the at least one coil.

2. The control device according to claim 1, wherein when said mobile armature is connected to a control current of a value of zero or less than an opening threshold current (D), the mobile armature is for rotating to said inactive position (R) under the force of attraction of the at least one permanent magnet and when connected to a control current of a value greater than a closing threshold current that is at least equal to the opening threshold current (D), the mobile armature is for rotating to said active position (T) under the force of repulsion of the at least noe permanent magnet.

3. The control device according to claim 2, wherein said mobile armature comprises opposing convex ends, the fixed frame comprises two permanent frame magnets oriented along a common axis of magnetization, the frame magnets positioned symmetrically relative to the axis of rotation of the mobile armature and each frame magnet having a substantially concave polar surface for cooperating with one of said opposing convex ends of the mobile armature to minimize a size of an air gap between the frame magnets and the mobile armature and to minimize variations in the size of said air gap during the movements of mobile armature.

4. The control device according to claim 3, wherein, the longitudinal axis of the core is angularly offset in a same direction from the axis of magnetism of the two permanent frame magnets, so that when the mobile armature is connected to a control current, the longitudinal axis of the core is shifted in the same angular direction, regardless of the position of the mobile armature.

5. The control device according to claim 4, further comprising a cage, wherein the at least one coil is mounted on the mobile armature by means of the cage, wherein said cage surrounds the core and comprises transverse rings at least one of which is for cooperating with one inside surface of the fixed frame.

6. The control device according to claim 5, said fixed frame comprises two flanges and said core comprises two lateral faces are in contact with said two flanges to allow electromagnetic flux generated by the to loop back between the metal core and the fixed frame.

7. The control device according to claim 1, wherein said two coils are mounted on the mobile armature and each has a lengthwise axis that is substantially perpendicular to the axis of rotation of the mobile armature, the two coils being electrically connected together in series.

8. The control device according to claim 1, wherein the control means comprise an electronics circuit for receiving an opening instruction and a closing instruction and for outputting a control current to the at least one coil.

9. The control device according to claim 8, wherein, when a closing instruction is received by the electronics circuit, said circuit is for outputting a control current having a value greater than a closing threshold current (E) and sufficient to cause the mobile armature to rotate to the active (T) position.

10. The control device according to claim 8, wherein, when an opening instruction is received by the electronics circuit, said circuit is for outputting a control current having a value of zero or less than the opening threshold current (D) and sufficient to cause the mobile armature to rotate to the inactive (R) position.

11. The control device according to claim 1, wherein, when the mobile armature is in the inactive (R) position, the contacts actuation lever is for separating mobile contacts from fixed contacts of a switching apparatus.

12. The control device according to claim 11, further comprising a contact compression spring, wherein, when the mobile armature is in the active (T) position, the contacts actuation lever is mechanically dissociated from mobile contacts of a switching apparatus and the contact compression spring is for urging the mobile contacts against fixed contacts of such a switching apparatus.

13. The control device according to claim 1, in combination with a switching apparatus comprising contacts, wherein said contacts actuation lever is for actuating said contacts.

* * * * *